United States Patent [19]

Jagst

[11] Patent Number: 4,955,111

[45] Date of Patent: Sep. 11, 1990

[54] TRAVELLING FLATS ASSEMBLY FOR A CARDING MACHINE

[75] Inventor: Peter Jagst, Mönchengladbach, Fed. Rep. of Germany

[73] Assignee: Trüzschler GmbH & Co. KG, Monchen-Gladbach, Fed. Rep. of Germany

[21] Appl. No.: 411,362

[22] Filed: Sep. 25, 1989

[30] Foreign Application Priority Data

Sep. 24, 1988 [DE] Fed. Rep. of Germany ..... 3832484
Mar. 8, 1989 [DE] Fed. Rep. of Germany ..... 3907396

[51] Int. Cl.[5] ..... D01G 15/08
[52] U.S. Cl. ..... 19/102
[58] Field of Search ..... 19/102, 103, 104, 109, 19/110, 111

[56] References Cited

U.S. PATENT DOCUMENTS

| | | | |
|---|---|---|---|
| 335,760 | 2/1886 | Leigh | 19/102 |
| 335,761 | 2/1886 | Leigh | 19/102 |
| 726,496 | 4/1903 | Batten et al. | 19/102 |
| 4,276,677 | 7/1981 | Piske | 19/102 |
| 4,580,318 | 4/1986 | Varga | 19/102 |

FOREIGN PATENT DOCUMENTS

| | | | |
|---|---|---|---|
| 1231225 | 10/1986 | Japan | 19/102 |
| 632016 | 9/1982 | Switzerland . | |
| 793488 | 4/1958 | United Kingdom | 19/102 |
| 870424 | 6/1961 | United Kingdom . | |
| 1315371 | 5/1973 | United Kingdom | 19/102 |
| 2121842 | 1/1984 | United Kingdom . | |

*Primary Examiner*—Werner H. Schroeder
*Assistant Examiner*—John J. Calvert
*Attorney, Agent, or Firm*—Spencer & Frank

[57] ABSTRACT

A travelling flats assembly for a carding machine comprises two end rollers; an endless flexible belt trained about the end rollers for a circulating travel, and a plurality of clothed flat bars arranged to be entrained by the endless flexible belt for circulating travel therewith. Each flat bar has a head forming a longitudinal end of the flat bar. There are further provided a stationary slide guide extending between the end rollers along the lower flight of the endless belt and slidably engaging and supporting the flat bars when entrained for travel by the lower flight; and a form-fitting connection for coupling the head of each flat bar to the outwardly-oriented face of the endless belt. The form-fitting connection allows an unobstructed freedom of motion of each flat bar in a direction generally perpendicularly away from and towards the outwardly-oriented belt face, whereby the flat bars are freely removable from and placed in an operative position onto the outwardly-oriented face of the upper flight of the endless belt.

24 Claims, 8 Drawing Sheets

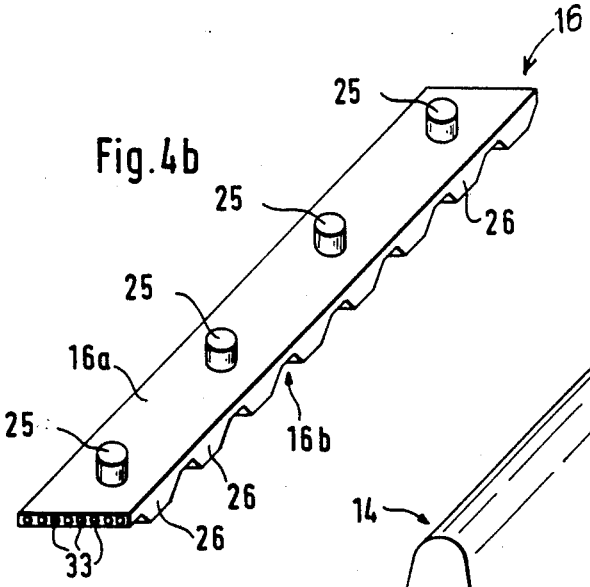
Fig.4b
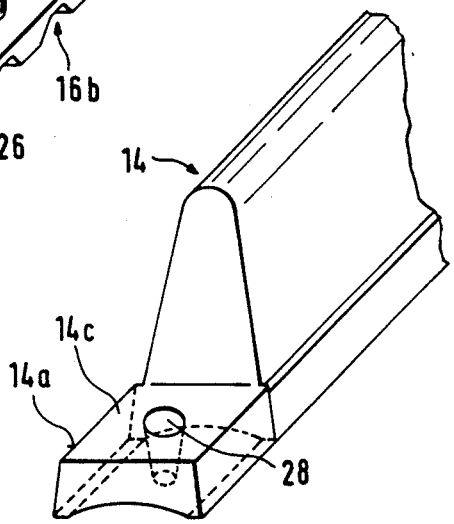
Fig.5a
Fig. 5b
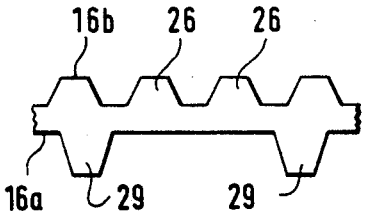
Fig. 5c
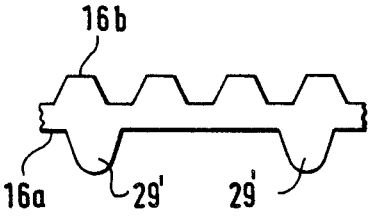

Fig. 6a
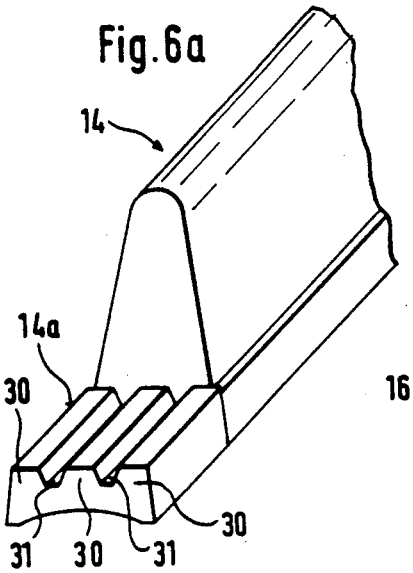
Fig. 6b
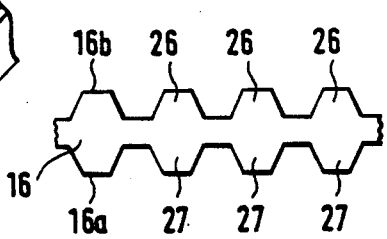
Fig. 7
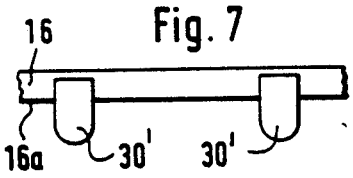
Fig. 8
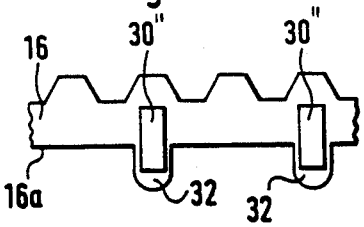
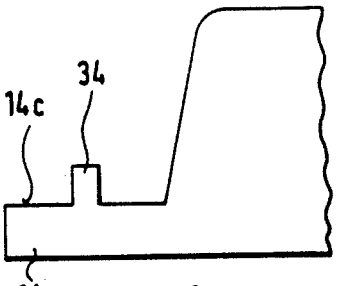
Fig. 9a
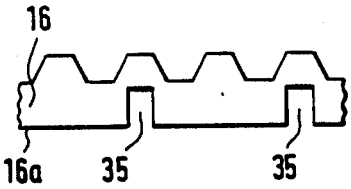
Fig. 9b Fig.10
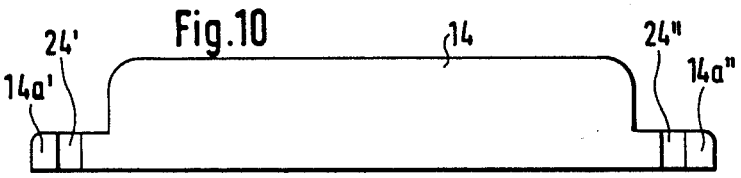
Fig.11a
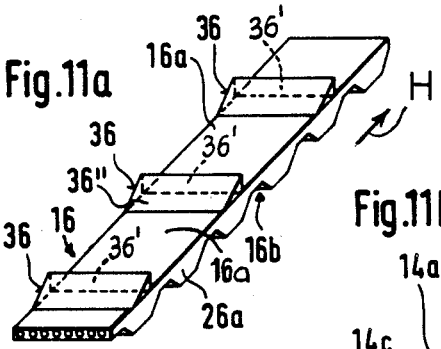
Fig.11b
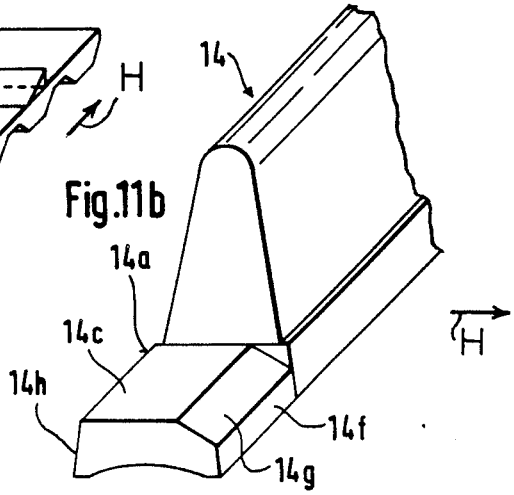
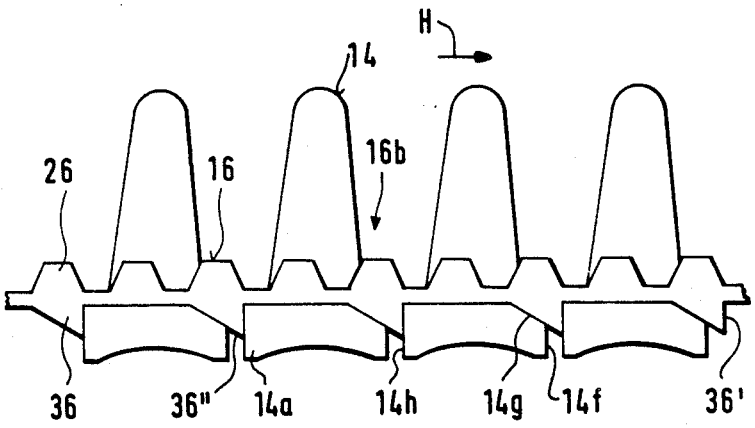
Fig.11c

TRAVELLING FLATS ASSEMBLY FOR A CARDING MACHINE

CROSS REFERENCE TO RELATED APPLICATION

This application claims the priority of Federal Republic of Germany Applications P 38 32 484.9 filed Sept. 24th, 1989 and P 39 07 396.3 filed Mar. 8th, 1989, which are incorporated herein by reference.

BACKGROUND OF THE INVENTION

This invention relates to a travelling flats assembly for a carding machine and is of the type which has a plurality of clothed flat bars carried by at least one endless flexible belt and wherein the flat bars slide at both ends on slide guides to execute a working pass and thereafter, deflected by an end roller, travel in the reverse direction to the beginning of their working pass.

In practice, the flat bars are pulled along the slide guides by two chains which are mounted to opposite ends (heads) of the flat bars. The attachment of the chain to each flat bar is effected at each end of the flat bar by a screw which extends axially through a bushing at the chain link articulation into bore which is provided in the flat bar head and which is provided with an inner thread. It is a disadvantage of this arrangement that providing the end of the flat bar head with an inner thread is technologically elaborate. It is a further disadvantage that the screw has to be tightened with a certain torque which renders the assembling operation—for example, after refurbishing the flats with a new clothing—time-consuming.

German Pat. No. 1,115,621 proposes to replace the chain with a toothed belt or a band. The band is secured to each flat bar head by a clamping plate which slides over an arcuate guide. The manufacture of the mounting components and the assembling operation are significantly complex. It is also a disadvantage of this prior art solution that similarly to the difficulties encountered with chains—due to the screw connection between the band and the flat bar heads, a replacement of the flat bars, particularly during operation, is not possible in a rapid and simple manner.

SUMMARY OF THE INVENTION

It is an object of the invention to provide an improved travelling flats assembly of the above-outlined type from which the discussed disadvantages are eliminated and which, in particular, may be manufactured and assembled in a simple manner and further, which permits the rapid replacement of flat bars.

This object and others to become apparent as the specification progresses, are accomplished by the invention, according to which, briefly stated, the travelling flats assembly for a carding machine comprises two end rollers; an endless flexible belt trained about the end rollers for a circulating travel; and a plurality of clothed flat bars arranged to be entrained by the endless flexible belt for circulating travel therewith. Each flat bar has a head forming a longitudinal end of the flat bar. There are further provided a stationary slide guide extending between the end rollers along the lower flight of the endless belt and slidably engaging and supporting the flat bars when entrained for travel by the lower flight; and a form-fitting connection for coupling the head of each flat bar to the outwardly-oriented face of the endless belt. The formfitting connection allows an unobstructed freedom of motion of each flat bar in a direction generally perpendicularly away from and towards the outwardly-oriented belt face, whereby the flat bars are freely removable from and placed in an operative position onto the outwardly-oriented face of the upper flight of the endless belt.

By virtue of the direct, form-locking (form-fitting) interengagement of the belt with the flat bar ends, additional securing elements such as screws or the like are not needed. This significantly simplifies the making and assembly of the flat bars. In operation, the ends of the flat bars are, by virtue of the form-locking engagement between the belt and the flat bars, pulled forwardly over the slide guides and during the return travel on that side of the travelling flats which is opposite the slide guides, the flat bar heads lie loosely on the belt and may be removed without hindrance therefrom and replaced. The flat bars, although they lie only loosely on the belt, do not drop therefrom since they are in a form-locking engagement with the belt.

The travelling flats according to the invention have additional advantageous features as follows:

- The outer edge of the belt is connected with that side of each flat bar which is remote from the clothing.
- The belt has at its outer side projections which engage into recesses provided at the flat bar ends.
- The belt has on its external (outwardly-oriented) face recesses which engage into projections provided at the flat bar ends.
- The projections and the recesses are cylindrical.
- The projections and the recesses are conical so that the projections will be centered upon insertion into the recesses.
- The flexible belt is a toothed belt provided with teeth on both belt faces, and the teeth on the inwardly oriented face mesh with two sprockets.
- At opposite ends of the travelling flat assembly two flat bar reversing elements are provided, formed of bent guiding and holding plates.
- For introducing the flat bars, between the deflecting element and the curved slide guide a linear guide element is provided which adjoins tangentially the curved slide guide.
- The belt is reinforced by tension stress-resistant steel wires, glass fibers, aramide fibers or the like.
- The upper flight of the belt is backed up by at least one supporting element such as a roller or a planar component.
- The belt has, at its external face, projections whose frontal faces, oriented in the direction of travel, abut an outer face of the flat bar heads. The rearwardly oriented surfaces of the projections are in engagement with chamfered outer faces of the flat bar heads.

BRIEF DESCRIPTION OF THE DRAWING

FIG. 4*b* is a fragmentary perspective view of a belt according to the preferred embodiment, designed to cooperate with the flat bar illustrated in FIG. 4*a*.

FIG. 5*a* is a fragmentary perspective view of a flat bar incorporating another preferred embodiment of the invention.

FIG. 5*b* is a fragmentary sectional side elevational view of a toothed belt structured to cooperate with the construction of FIG. 5*a*.

FIG. 5*c* is a fragmentary sectional side elevational view of a toothed belt structured to cooperate with the construction of FIG. 5*a*.

FIG. 6*a* is fragmentary perspective view of a flat bar incorporating still another preferred embodiment of the invention.

FIG. 6*b* is a fragmentary sectional side elevational view of a bilaterally toothed belt configured to cooperate with the construction of FIG. 6*a*.

FIG. 7 is a fragmentary sectional side elevational view of a belt incorporating still another preferred embodiment of the invention.

FIG. 8 is fragmentary sectional side elevational view of a toothed belt incorporating a further preferred embodiment of the invention.

FIG. 9*a* is a fragmentary side elevational view of a flat bar incorporating still a further preferred embodiment of the invention.

FIG. 9*b* is a fragmentary sectional side elevational view of a toothed belt configured to cooperate with the construction of FIG. 9*a*.

FIG. 10 is a sectional side elevational view of a flat bar having opposite flat bar heads incorporating another preferred embodiment of the invention.

FIG. 11*a* is a fragmentary perspective view of a toothed belt incorporating still another preferred embodiment of the invention.

FIG. 11*b* is a fragmentary perspective view of a flat bar configured to cooperate with the embodiment shown in FIG. 11*a*.

FIG. 11*c* is a schematic side elevational view of the components shown in FIGS. 11*a* and 11*b* in an interengaging relationship.

DESCRIPTION OF THE PREFERRED EMBODIMENTS

Figure 1:
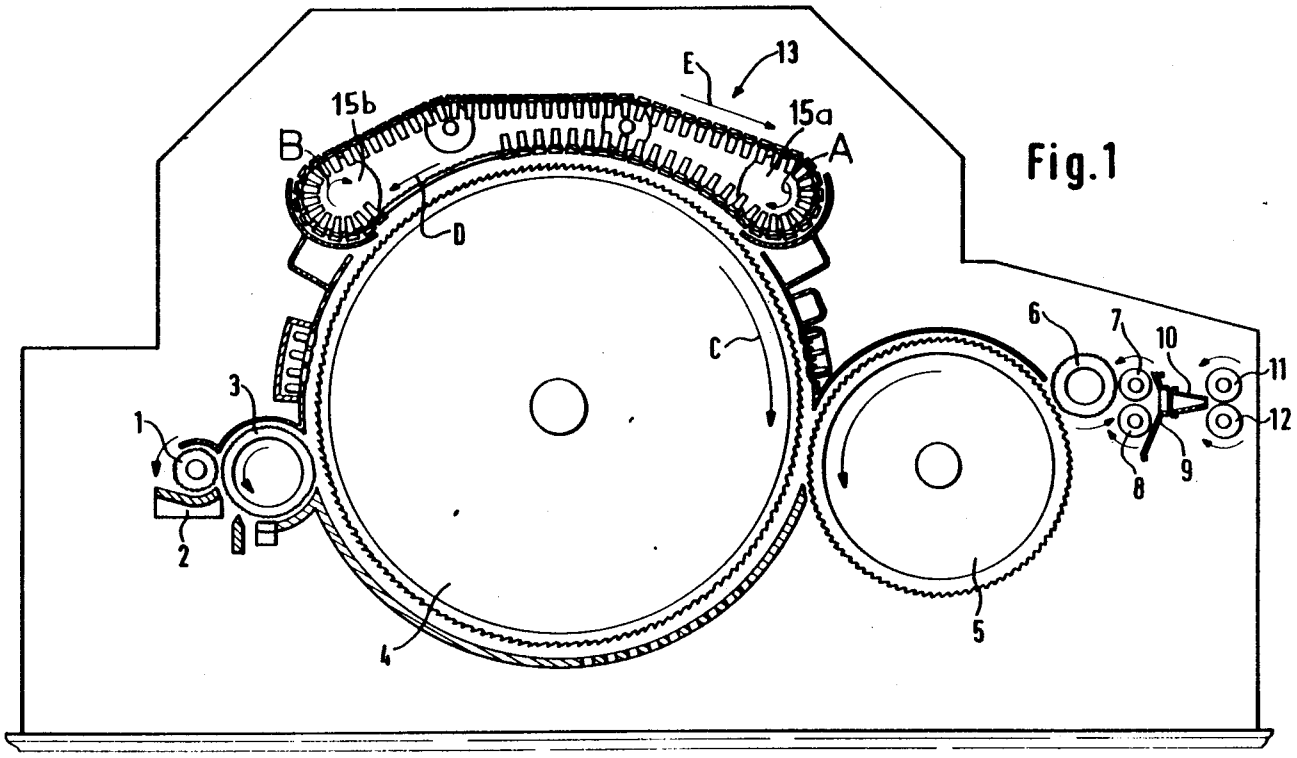
FIG. 1 is a schematic side elevational view of a carding machine including a travelling flats assembly which incorporates the invention.

Turning to FIG. 1, there is illustrated therein a carding machine which may be an EXACTACARD DK 740 model manufactured by Trützschler GmbH & Co. KG, Mönchengladbach, Federal Republic of Germany. The card has a feed roller 1 cooperating with a feed table 2, a licker-in 3, a main carding cylinder 4, a doffer 5, a stripper roller 6, crushing rollers 7 and 8, a web guiding element 9, a sliver trumpet 10, calender rollers 11, 12 and a travelling flats assembly 13.

Figure 2:
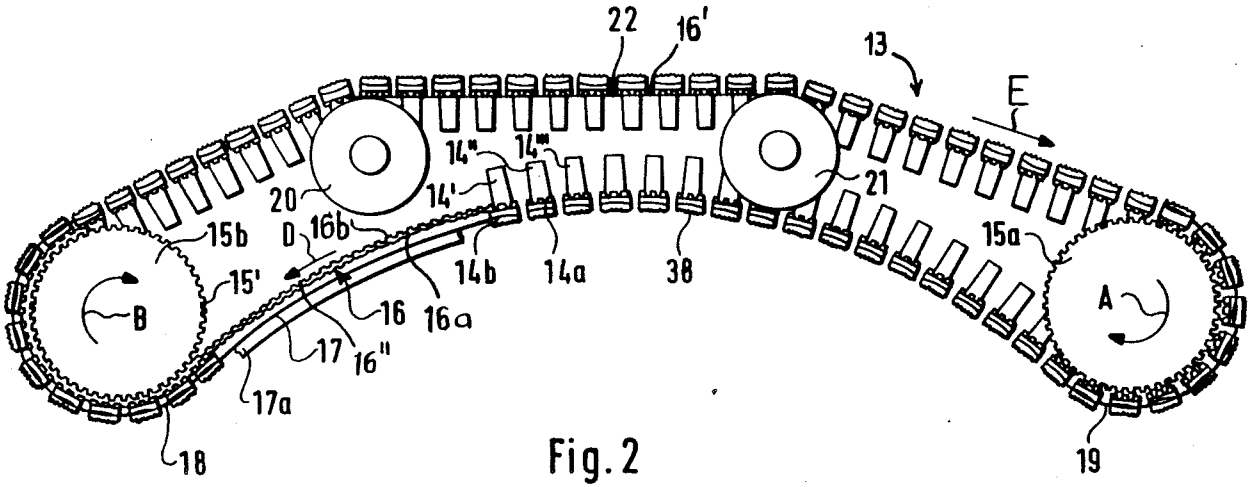
FIG. 2 is a schematic side elevational view, on an enlarged scale relative to FIG. 1, of the travelling flats assembly incorporating the invention.

Also referring to FIG. 2 which shows the travelling flats assembly 13 in further detail, the travelling flats assembly has an endless flexible belt 16 which advances the serially arranged flat bars 14 and which is supported at its ends by respective end sprockets 15*a* and 15*b* whose respective direction of rotation A and B is the same as the direction of rotation C of the main carding cylinder 4. The flexible belt 16 has an upper flight 16′ and a lower flight 16″. The flat bars 14 are advanced by the toothed belt 16 in the direction D over a slide guide 17. On the upper side of the travelling flats assembly 13, that is, on the side opposite the slide guide 17, the flat bars 14 are moved in the reverse direction as indicated by the arrow E.

Each flat bar 14 glides with its underside 14*b* of their flat bar heads 14*a* (which constitutes the opposite respective ends of each flat bar 14) on the slide guide 17 of a flexible bend 17*a*. The sprocket 15*b* which has teeth 15′ and which rotates in the direction of arrow B meshes with the teeth provided on the inwardly oriented side 16*b* of the toothed belt 16 and pulls the lower flight 16″ of the toothed belt 16 in the direction of the arrow D. The outwardly oriented side 16*a* of the toothed belt 16 is in a form-locking (form-fitting) engagement with that side 14*c* of the flat bar head 14*a* of each flat bar 14 which is opposite to the respective clothing 38 secured to the flat bar. By virtue of its arcuate course and by the forces derived by the belt tension, the belt 16 presses the flat bar heads 14*a* against the slide guide 17. Adjacent and conforming to the periphery of the sprocket 15*b* there extends a curved guiding and holding element 18 which retains the flat bars 14 during their circular travel on the sprocket 15*b*. At the other end of the travelling flats assembly 13, the sprocket 15*a* meshes with the teeth of the belt 16 at the inner side 16*b* thereof and pulls the upper belt flight 16′ in the direction of the arrow E. The flat bar heads 14*a* are loosely positioned on the outer side 16*a* of the upper flight 16′ of the belt 16. Adjacent and conforming to the sprocket 15*a* there is provided a guiding and holding element 19 which retains the flat bars 14 during their circular travel on the sprocket 15*a*. The upper flight 16′ of the toothed belt 16 is backed up by two support rollers 20 and 21 and by a planar support 22. The support rollers 20, 21 are sprockets which mesh with the teeth provided on the inwardly oriented face 16*b* of the toothed belt 16.

Figure 3:
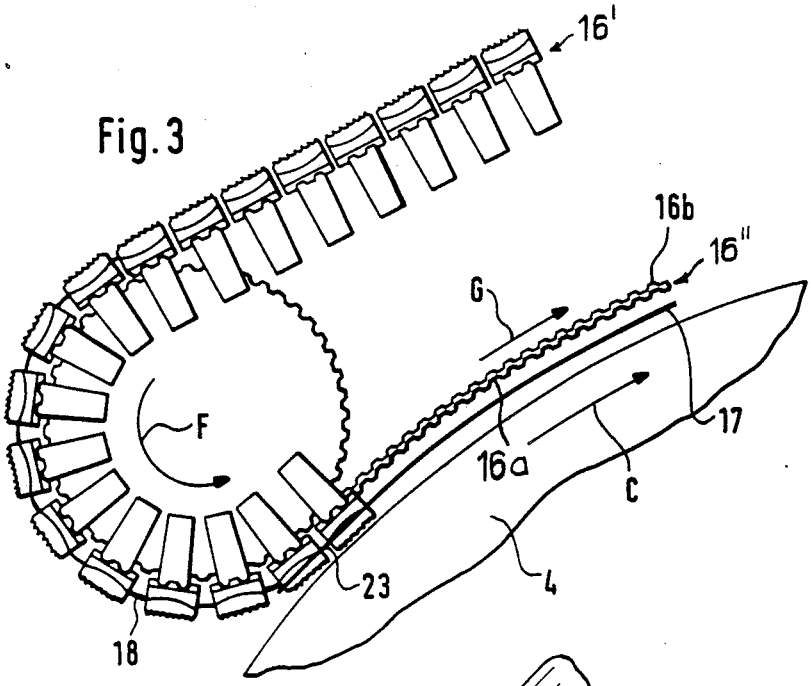
FIG. 3 is a fragmentary schematic side elevational view, on an enlarged scale relative to FIG. 2, of the travelling flats assembly showing further details of the preferred embodiment.

Referring to FIG. 3, the travelling flats assembly depicted therein is driven in the opposite direction as compared to FIGS. 1 and 2 so that the lower flight 16″ of the belt 16 travels in the direction G which coincides with the travelling direction C of those portions of the main carding cylinder 4 which cooperate with the travelling flats. Between the guiding and retaining element 18 and the slide guide 17 there is arranged a linear guiding element 23 which tangentially adjoins the curved slide guide 17. The guiding element 23 is arranged at a location upstream of the zone where the flat bars 14 run onto the slide guide 17.

Figure 4A:
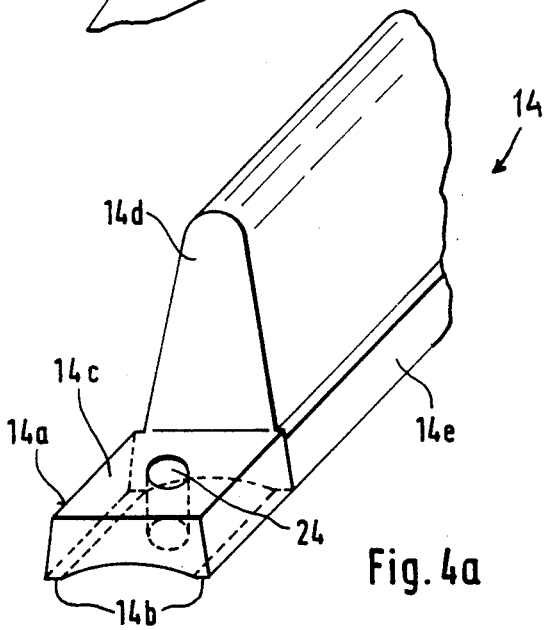
FIG. 4*a* is a fragmentary perspective view of a flat bar according to a preferred embodiment.

Turning to FIG. 4*a*, there is illustrated therein an end portion of a flat bar 14 which has a back 14*d* and a clothing holder 14*e*. The end of the flat bar 14 terminates in a flat bar head 14*a* which glides on the slide guide 17. The flat bar head 14*a* has a throughgoing cylindrical aperture 24 which is oriented perpendicularly to the top surface 14*c* of the flat bar head 14*a*. FIG. 4*b* shows the belt 16 which on its outwardly oriented surface 16a carries projections 25 made, for example, of rubber. Each projection 25 extends during operation into a respective bore 24 of the flat bar heads 14a. On the inwardly oriented face 16b of the belt 16 teeth 26 are provided for cooperating with the teeth of the end sprockets 15a, 15b. The belt 16 is reinforced by longitudinally oriented, tension-resistant, flexible steel wires 33.

The embodiment illustrated in FIG. 5a is similar to that shown in FIG. 4a except that a throughgoing frustoconical opening 28 is provided which tapers in a direction away from the flat bar head face 14c. FIG. 5b shows that the inwardly oriented face 16b of the belt 16 has teeth 26 while the outwardly oriented face 16a of the belt 16 has frustoconical projections 29 adapted to extend into a respective frustoconical opening 28. In the embodiment shown in FIG. 5c the projections 29' are provided with a generally hemispherical terminus whereas the projections 29 of the FIG. 5b embodiment have a planar end face.

FIG. 6a shows an end portion of the flat bar 14 wherein the flat bar head 14a has on its upper face teeth 30 alternating with tooth gaps 31, having a length dimension oriented parallel to the length dimension of the flat bar 14. FIG. 6b shows a belt 16 which, on its outwardly oriented face 16a has teeth 27 and on its inwardly oriented face 16b has teeth 26. The teeth 27 of the belt 16 mesh with respective tooth gaps 31 of the flat bar head 14a whereas the teeth 30 of the flat bar head 14a extend into the tooth gaps between the teeth 27 on the outwardly oriented face 16a of the belt 16. The teeth 26 on the inwardly oriented surface 16b of the belt 16 are adapted to mesh with the teeth of the sprocket wheels 15a, 15b, 20 and 21 as described earlier in conjunction with FIG. 2.

Turning now to the embodiment illustrated in FIG. 7, the outwardly oriented face 16a of the belt 16 is provided with projections, for example, metal pins 30' which, at one end, for example by vulcanization, are secured to the belt 16 and whose other end projects beyond the surface of the outwardly oriented outer belt face 16a.

In the embodiment shown in FIG. 8, pins 30" are fully embedded in the belt 16 and serve for reinforcing projections 32 which form part of the belt 16.

Turning to FIGS. 9a and 9b, in the embodiment shown therein the flat bar head 14a is provided with a projection 34 which extends upwardly from the upper face 14c to be received by one of the recesses 35 provided in the outwardly oriented face 16a of the belt 16.

Turning to FIG. 10, there is shown a flat bar 14 in its entire length. It has two opposite flat bar head 14a' and 14a" each provided with throughgoing cylindrical openings 24' and 24" similarly to the embodiment illustrated in FIG. 4a.

FIGS. 11a and 11b show, respectively, the belt 16 and a flat bar 14 according to another preferred embodiment of the invention, while FIG. 11c shows the flat bars 14 in engagement with the belt 16. The belt 16 has on its externally oriented face 16a roof-like projections 36 whose leading faces 36' (as viewed in the direction of belt travel) are in a face-to-face engagement with the outer face 14h of each flat bar head 14a. The leading face 36' and the outer face 14h form an angle of approximately 90° with the belt face 16a. Each projection 36 has a rearwardly oriented face 36" which is in a face-to-face engagement with an oblique external face 14g of the respective flat bar head 14a. In FIGS. 11a, 11b and 11c the arrow H indicates the travelling direction of the flat bars 14 and the belt 16.

Figure 12A:
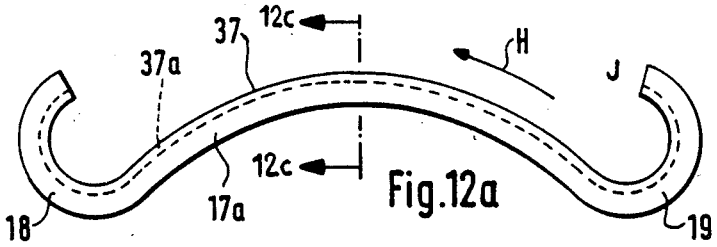
FIG. 12*a* is a side elevational view of a guide component according to the invention.
Figure 12B:
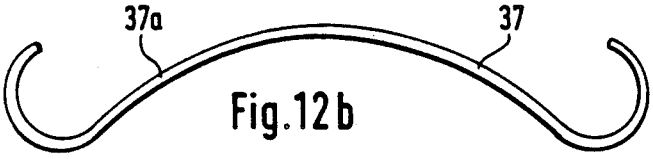
FIG. 12*b* is a side elevational view of an element forming part of the structure shown in FIG. 12*a*.
Figure 12C:
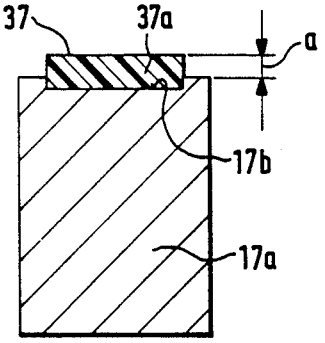
FIG. 12*c* is a sectional view taken along line XII*c*—XII*c* of FIG. 12*a*.

Turning to FIG. 12a, there is shown therein the flexible bend 17a whose two ends are adjoined by the guiding and retaining elements 18 and 19. As seen in FIG. 12c, in the upper face of the flexible bend 17a, the element 18 and the element 19 a longitudinal groove 17b is provided which receives a plastic insert 37a. The latter is a bar-shaped component conforming to the curvature of the bend 17a and the terminal elements 18 and 19. The plastic element 37a projects beyond the upper face of the flexible bend 17a by a distance a and is with one end secured to the entrance side J for the flat bars 14. The plastic element 37a constitutes a slide guide 37 on which the underface of each flat bar head 14a may directly slide. By virtue of this structure, a flexible bend 17a is provided which has integrated arcuate guiding and retaining elements 18, 19 and a bed (groove) 17b for a synthetic slide track. The incoming flat bars 14 flex the slide track into its shape shown in FIG. 12b and immobilized in the guide groove 17b of the flexible bend 17a and the integrated guide elements 18 and 19. The synthetic element 37a is preferably a self-lubricating plastic such as a high-molecular, low-pressure polyethylene to thus provide a maintenance-free track for the travelling flats. In particular, there is no longer a need for lubricating the conventionally used flat chains which is labor-intensive and leads to soiling because of the adherence of fibers. The material is highly wear-resistant, has a long service life and superior sliding properties and thus causes only small frictional losses. Such a material has, during sliding dry friction with the surfaces 14b of the metallic flat bar heads 14a, self-lubricating properties, particularly because of its paraffin-like surface.

Figure 12D:
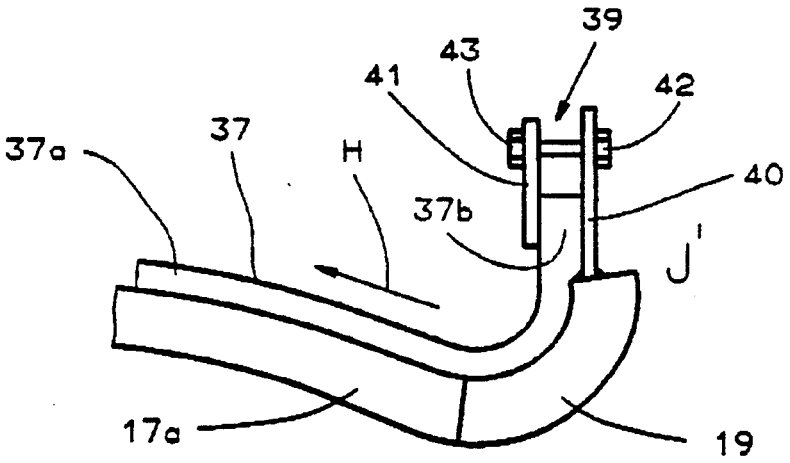
FIG. 12*d* is a fragmentary side elevational view of the guide component and the element shown separately in FIGS. 12*a* and 12*b* and further illustrating a securing device.

Turning to FIG. 12d, the plastic element 37a is, at its end 37b secured to the deflecting element 19 by a mounting device 39 at the run-in (inlet) location J' of the flexible bend 17a. The mounting device 39 comprises a holding element 40 which is affixed to an end of the deflecting element 19 and which, by means of a clamping element 41 securely clamps the end 37b of the plastic guide element 37a to the holder element 40. Such a clamping relationship is ensured by tightening a screw and nut assembly 42, 43 connecting the holding element 40 with the clamping element 41.

Figure 13:
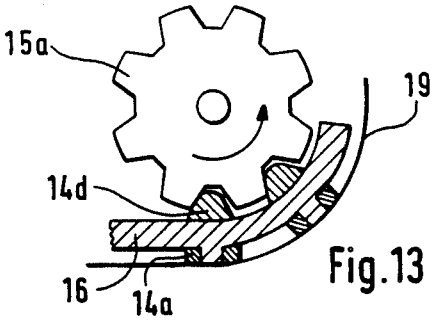
FIG. 13 is a schematic side elevational view of further components of the invention.

According to the arrangement shown in FIG. 13, the teeth of the sprockets 15a, 15b mesh with the flat bar backs 14d for advancing the travelling flats.

The faces 14b of the flat bar heads 14a (see FIG. 4a) are in a direct contact either with the slide faces of the deflecting (guiding and retaining) elements 18 and 19 according to FIGS. 1, 2, 3 and 13 or with the slide faces 37 of the synthetic elements 37a which are shown in FIG. 12 and which project beyond the outer faces of the elements 18 and 19.

Figure 14:
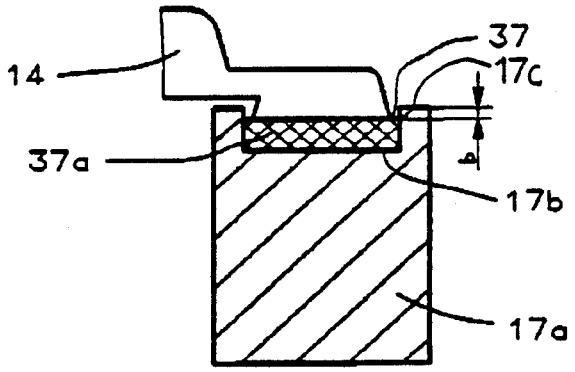
FIG. 14 is a sectional view of a variant of the guide component shown in FIG. 12*c*.

Turning now to FIG. 14, there is shown therein a variant of the embodiment illustrated in FIG. 12c. In the embodiment according to FIG. 14, the plastic element 37a is received in the guide groove 17b in such a manner that the slide surface 37 is recessed by a distance b below the upper edge face 17c of the flexible bend 17a.

Expediently, the slide guide 17 and/or the underfaces 14b of the flat bars 14 are formed at least partially by a self-lubricating element made of a metallic material, such as a bearing material, impregnated with oil or grease.

It is an advantage of the invention that the flat bars -14 are pulled forwardly by the flexible belt wherein the end rollers 15a, 15b serve as driving (pulling) elements.

While most of the structures have been described in conjunction with one end of each flat bar, it is to be understood that such a structure is duplicated at the other end of the flat bars, that is, on the other side of the carding machine.

It is a salient advantage of the invention that the flat bars may be removed from the belt of the travelling flats assembly during operation without manipulating separate connecting elements such as screws, in contradistinction to known arrangements. By virtue of a direct cooperation between the belt and the flat bar heads, a forward advance as well as a return travel of the flat bars 14 is effected.

It is thus a particular advantage of the invention that because the only securement between the flat bars and the belt is a form-fitting interengagement, the flat bars 14 may be installed into or removed from the travelling flats assembly 13 merely by placing the flat bars onto or lifting them off the outwardly oriented face 16a of the upper flight 16' of the belt 16.

It will be understood that the above description of the present invention is susceptible to various modifications, changes and adaptations and the same are intended to be comprehended within the meaning and range of equivalents of the appended claims.

What is claimed is:

1. A travelling flats assembly for a carding machine, comprising (a) two end rollers;

(b) an endless flexible belt trained about the end rollers for a circulating travel and having a lower, working flight and an upper, return flight; said endless flexible belt further having an outwardly-oriented face and an inwardly-oriented face;

(c) a plurality of clothed flat bars arranged to be entrained by said endless flexible belt for circulating travel therewith; each said flat bar having a head forming a longitudinal end of the flat bar;

(d) a stationary slide guide extending between said end rollers along said lower flight and slidably engaging and supporting the flat bars when entrained for travel by said lower flight; and (e) form-fitting connecting means for coupling the head of each flat bar to said outwardly-oriented face of said endless belt; said form-fitting connecting means allowing unobstructed freedom of motion of each flat bar in a direction generally perpendicularly away from and towards said outwardly-oriented face, whereby said flat bars are freely removable from and placed in an operative position onto the outwardly-oriented face of the upper flight of said endless belt.

2. A travelling flats assembly as defined in claim 1, wherein said head of each flat bar has opposite first and second head faces; said outwardly-oriented face of said endless belt being in a face-to-face engagement with said first head face and said stationary slide guide being in a gliding engagement with said second head face.

3. A travelling flats assembly as defined in claim 1, further comprising teeth provided on said inwardly-oriented face of said endless belt; further wherein said end rollers are sprocket wheels meshing with said teeth.

4. A travelling flats assembly as defined in claim 1, further comprising a support roller situated between said end rollers and being in a supporting engagement with said inwardly-oriented face of the upper flight of said endless belt.

5. A travelling flats assembly as defined in claim 1, wherein said form-fitting connecting means comprises first teeth provided on said outwardly-oriented face of said endless belt and second teeth formed on said head of each said flat bar; said first and second teeth are in a meshing relationship with one another.

6. A travelling flats assembly as defined in claim 5, further comprising third teeth provided on said inwardly-oriented face of said endless belt; further wherein said end rollers are sprocket wheels meshing with said third teeth.

7. A travelling flats assembly as defined in claim 1, wherein said form-fitting connecting means comprises a series of depressions provided in said outwardly-oriented face of said endless belt and being spaced in a direction parallel to the direction of belt travel; said form-fitting connecting means further comprising a projection provided in said head of each said flat bar; said depressions form-fittingly receiving respective said projections.

8. A travelling flats assembly as defined in claim 7, wherein the projections and depressions are cylindrical.

9. A travelling flats assembly as defined in claim 7, wherein the projections and depressions are conical

10. A travelling flats assembly as defined in claim 1, further comprising flat bar guiding and supporting means situated adjacent said end rollers for retaining said flat bars against said outwardly-oriented face of said endless belt during circular travel thereof about said end rollers.

11. A travelling flats assembly as defined in claim 10, wherein said flat bar guiding and supporting means comprises curved sheet metal elements extending radially spaced from said end rollers and conforming to outer peripheries thereof.

12. A travelling flats assembly as defined in claim 10, wherein said stationary slide guide has a curvilinear course as viewed in the travelling direction of said endless belt; further comprising a flat bar guide of linear course disposed between said stationary slide guide and said flat bar guiding and supporting means at one of said end rollers; said flat bar guide of linear course tangentially joining an upstream end of said stationary slide guide, as viewed in the travelling direction of the lower flight of said endless belt.

13. A travelling flats assembly as defined in claim 1, wherein said form-fitting connecting means comprises a series of projections affixed to said outwardly-oriented face of said endless belt and being spaced in a direction parallel to the direction of belt travel; said projections extending generally perpendicularly from said outwardly-oriented face; said form-fitting connecting means further comprising an aperture provided in said head of each said flat bar; said aperture form-fittingly receiving a respective said projection.

14. A travelling flats assembly as defined in claim 13, wherein the projections and the apertures are cylindrical.

15. A travelling flats assembly as defined in claim 13, wherein the projections and the apertures are conical.

16. A travelling flats assembly as defined in claim 1, wherein said form-fitting connecting means comprises a series of projections provided on said outwardly-oriented face of said endless belt; said projections being spaced from one another in a direction parallel to the travelling direction of the endless belt; each said projection having a leading face as viewed relative to the travelling direction; said leading face being oriented substantially perpendicular to the travelling direction; said form-fitting connecting means further including a contact face provided on said head of each said flat bar; the leading face of respective said projections being in a face-to-face engagement with the contact face of respective said heads of the flat bars.

17. A travelling flats assembly as defined in claim 16, wherein each said projection further has a trailing face; said contact face provided on each said flat bar being a first contact face; further comprising a second contact face provided on said head of each said flat bar; the trailing face of respective said projections being in a face-to-face engagement with the second contact face of respective said heads of the flat bars.

18. A travelling flats assembly as defined in claim 17, wherein the trailing face of each said projection slopes at an oblique angle away from said outwardly-oriented face of said endless belt and intersects the leading face of the projection.

19. A travelling flats assembly as defined in claim 1, wherein said stationary slide guide comprises a flexible bend carrying a plastic element having a slide face being in gliding contact with said head of said flat bars.

20. A travelling flats assembly as defined in claim 19, further comprising a groove provided in said flexible bend; said plastic element being received in said groove.

21. A travelling flats assembly as defined in claim 20, further comprising a curved guiding and supporting element situated adjacent each said end roller for retaining said flat bars against said outwardly-oriented face of said endless belt during circular travel thereof about said end rollers; each said curved guiding and supporting element extending radially spaced from the respective said end roller and conforming to an outer periphery thereof; the curved guiding and supporting elements adjoining opposite longitudinal ends of said flexible bend having a groove accommodating said plastic element.

22. A travelling flats assembly as defined in claim 19, wherein said flexible bend has an outer edge face oriented toward said flat bars and further wherein said plastic element projects beyond said outer edge face.

23. A travelling flats assembly as defined in claim 20, wherein said slide face is situated in said groove, in a recessed relationship with respect to a outer edge forming part of said flexible bend and oriented toward said flat bars.

24. A travelling flats assembly as defined in claim 1, wherein said stationary slide guide is formed a least in part of a self-lubricating element impregnated with a lubricant.

* * * * *